US009544946B2

(12) United States Patent
Oh et al.

(10) Patent No.: US 9,544,946 B2
(45) Date of Patent: Jan. 10, 2017

(54) INDUCTION HEAT COOKING APPARATUS AND METHOD FOR CONTROLLING OUTPUT LEVEL THEREOF

(71) Applicant: LG ELECTRONICS INC., Seoul (KR)

(72) Inventors: Dooyong Oh, Seoul (KR); Heesuk Roh, Seoul (KR); Byeongwook Park, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 362 days.

(21) Appl. No.: 14/145,357

(22) Filed: Dec. 31, 2013

(65) Prior Publication Data

US 2014/0183182 A1 Jul. 3, 2014

(30) Foreign Application Priority Data

Jan. 2, 2013 (KR) ..... 10-2013-0000083

(51) Int. Cl.
*H05B 6/04* (2006.01)
*H05B 6/06* (2006.01)

(52) U.S. Cl.
CPC ..... *H05B 6/062* (2013.01); *H05B 2213/05* (2013.01)

(58) Field of Classification Search
CPC ..... H05B 6/04; H05B 6/06; H05B 6/062; H05B 6/02; H05B 6/101; H05B 6/1236; H05B 6/1272; H05B 6/1281
USPC ..... 219/660, 661, 662, 670, 671, 620, 624,219/625, 626
See application file for complete search history.

(56) References Cited

U.S. PATENT DOCUMENTS

| | | | | |
|---|---|---|---|---|
| 4,210,792 | A * | 7/1980 | Higuchi | H05B 6/062 219/626 |
| 4,356,371 | A | 10/1982 | Kiuchi et al. | |
| 5,329,100 | A | 7/1994 | Lee | 219/626 |
| 5,490,450 | A | 2/1996 | Lee | 99/337 |
| 5,951,904 | A | 9/1999 | Jung et al. | 219/626 |
| 6,528,770 | B1 | 3/2003 | Akel et al. | 219/624 |
| 2007/0268729 | A1 | 11/2007 | Choi | |
| 2012/0152935 | A1 | 6/2012 | Kitaizumi et al. | |

(Continued)

FOREIGN PATENT DOCUMENTS

| | | |
|---|---|---|
| JP | 3-263788 A | 11/1991 |
| JP | 2010-140657 A | 6/2010 |

OTHER PUBLICATIONS

European Office Action dated Jan. 29, 2016 issued in Application No. 13199745.4.

(Continued)

*Primary Examiner* — Hung D Nguyen
(74) *Attorney, Agent, or Firm* — Ked & Associates, LLP

(57) ABSTRACT

Provided is an induction heat cooking apparatus. The induction heat cooking apparatus includes a rectifying part rectifying an input voltage to output a DC voltage; an inverter switching the DC voltage outputted through the rectifying part to generate an AC voltage; a first heating part operated by the AC voltage applied from the inverter; a second heating part connected to the first heating part in parallel, the second heating part being operated by the AC voltage applied from the inverter; and a switching signal generation part controlling an operation state of each of the first and second heating parts from the inverter according to an operation mode inputted from the outside. The switching signal generation part includes a pulse transformer.

11 Claims, 5 Drawing Sheets

(56) References Cited

U.S. PATENT DOCUMENTS

2012/0321761 A1* 12/2012 De la Cuerda Ortin ..... H05B 6/062 219/650

OTHER PUBLICATIONS

European Search Report issued in related Application No. 13199745.4 dated Jul. 3, 2014.
U.S. Office Action dated May 16, 2016 issued in co-pending U.S. Appl. No. 14/145,428.
U.S. Office Action dated Jun. 10, 2016 issued in co-pending U.S. Appl. No. 14/145,484.
Jung, Yong-Chae: "Dual half bridge series resonant inverter for induction heating appliance with two loads"; Electronics Letters; IEE Stevenage, GB; vol. 35, No. 16; Aug. 5, 1999; pp. 1345-1346; XP006012499.
European Search Report dated Oct. 17, 2016 issued in Application No. 13199738.9.

* cited by examiner

INDUCTION HEAT COOKING APPARATUS AND METHOD FOR CONTROLLING OUTPUT LEVEL THEREOF

CROSS-REFERENCE TO RELATED APPLICATIONS

The present application claims priority under 35 U.S.C. §119 to Korean Patent Application No. 10-2013-0000083 filed on Jan. 2, 2013, whose entire disclosure is hereby incorporated by reference in its entirety.

BACKGROUND

1. Field

The present disclosure relates to an induction heat cooking apparatus, and more particularly, to an induction heat cooking apparatus including an inverter, which is constituted by three switching devices, and two resonant circuits and a method for controlling an output level thereof.

2. Background

Induction heat cooking apparatuses having inverters are known. However, they suffer from various disadvantages.

BRIEF DESCRIPTION OF THE DRAWINGS

The embodiments will be described in detail with reference to the following drawings in which like reference numerals refer to like elements wherein.

DETAILED DESCRIPTION OF THE EMBODIMENTS

Hereinafter, embodiments of the present disclosure will be described in detail with reference to the accompanying drawings.

In general, induction heat cooking apparatuses are electrical cooking apparatuses in which high-frequency current flows into a heating element (e.g., working coil or heating coil), and thus eddy current flows while a strong magnetic flux generated due to the flowing of the high-frequency current passes through a cooking container to heat the container itself, thereby performing a cooking function.

According to a fundamental heating principle of such an induction heat cooking apparatus, as current is applied to the heating coil, heat is generated in the cooking container that is a magnetic substance by induction heating. Thus, the cooking container itself may be heated by the generated heat to perform the cooking function.

An inverter used in the induction heat cooking apparatus serves as a switching device for switching a voltage applied to the heating coil so that the high-frequency current flows into the heating coil. The inverter may operate a switching device constituted by a general insulate gate bipolar transistor (IGBT) to allow high-frequency current to flow into the heating coil, thereby generating high-frequency magnetic fields around the heating coil.

When two heating coils are provided in the induction heat cooking apparatus, two inverters are needed to operate the two heating coil at the same time. Also, although the two heating coils are provided in the induction heat cooking apparatus, if one inverter is provided, a separate switch may be provided to selectively operate only one of the two heating coils.

Figure 1:
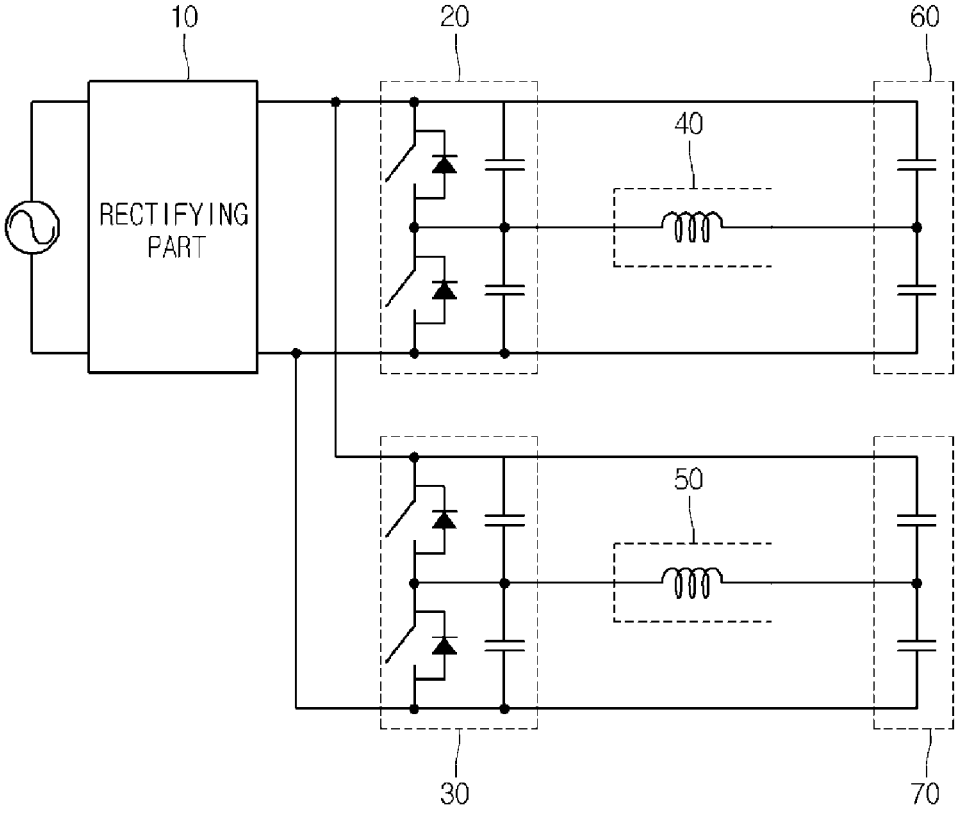
FIG. 1 is a view of an induction heat cooking apparatus according to one embodiment.

FIG. 1 is a view of an induction heat cooking apparatus according to one embodiment. Here, the induction heat cooking apparatus includes two inverters and two heating coils.

Referring to FIG. 1, an induction heat cooking apparatus includes a rectifying part 10, a first inverter 20, a second inverter 30, a first heating coil 40, a second heating coil 50, a first resonant capacitor 60, and a second resonant capacitor 70.

The first and second inverters 20 and 30 are respectively connected to switching devices for switching input power in series. The first and second heating coils 40 and 50 operated by an output voltage of each of the switching devices are respectively connected to contact points of the switching devices that are respectively connected to the first and second heating coils 40 and 50 in series. Also, the first and second heating coils 40 and 50 have the other sides respectively connected to the resonant capacitors 60 and 70.

The operation of each of the switching devices may be performed by a driving part. A switching time outputted from each of the driving parts may be controlled to apply a high-frequency voltage to the heating coils while the switching devices are alternately operated. Since a closing/opening time of the switching device applied from the driving part is controlled to gradually compensate the closing/opening time, a voltage supplied into each of the heating coils may be converted from a low voltage to a high voltage.

The induction heat cooking apparatus should include two inverter circuits to operate the two heating coils. Thus, one disadvantage in this embodiment is that the product may increase in volume as well as price due to multiple inverter circuits that are required.

Figure 2:
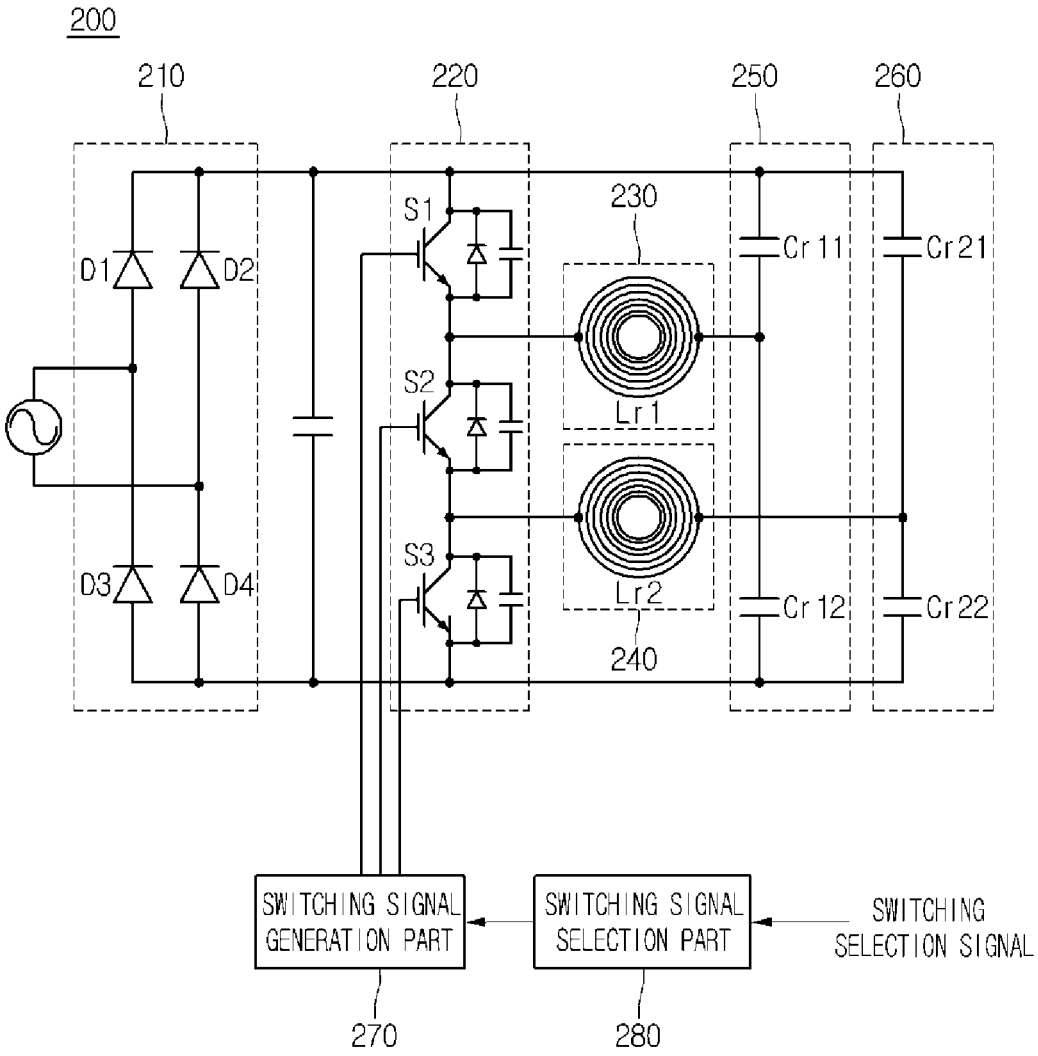
FIG. 2 is circuit diagram of an induction heat cooking apparatus according to one embodiment.

FIG. 2 is circuit diagram of an induction heat cooking apparatus according to another embodiment.

Referring to FIG. 2, an induction heat cooking apparatus 200 includes a rectifying part 210 receiving a commercial power AC from the outside to rectify the received commercial power into a DC voltage, an inverter 220 (S1, S2, and S3) connected between a positive power terminal and a negative power terminal in series to switch the terminals according to a control signal, thereby providing a resonant voltage, a first heating coil Lr1 (230) connected to an outer terminal of the inverter 220, a second heating coil Lr2 (240) connected to the output terminal of the inverter 220 and connected to the first heating coil 230 in parallel, first resonant capacitors Cr11 and Cr12 (250) connected to an outer terminal of the first heating coil Lr1 (230) and including a plurality of capacitors connected to each other in parallel, second resonant capacitors Cr21 and Cr22 (260) connected to an output terminal of the second heating coil Lr2 (240) and including a plurality of capacitors connected to each other in parallel, a switching signal generation part 270 (also referred to herein as a switching/control signal generator or controller) supplying a switching signal into each of the switches S1, S2, and S3 provided in the inverter 220 according to an operation mode, and a switching signal selection part 280 (also referred to herein as a controller) receiving a switching selection signal from the outside to select a switching signal to be generated in the switching signal generation part 270 according to the switching selection signal, thereby outputting the selected switching signal to the switching signal generation part 270.

In FIG. 2, an unexplained capacitor may represent a smoothing capacitor. The smoothing capacitor may allow a pulsating DC voltage rectified in the rectifying part 210 to be smooth, thereby generate a constant DC voltage.

Hereinafter, a connection relationship between the components included in the induction heat cooking apparatus will be described.

The rectifying part 210 includes a first rectifying part D1, a second rectifying part D2, a third rectifying part D3, and a fourth rectifying part D4.

The first rectifying part D1 and the third rectifying part D3 are connected to each other in series. The second rectifying part D2 and the fourth rectifying part D4 are connected to each other in series.

The inverter 220 includes a plurality of switches, e.g., a first switch S1, a second switch S2, and a third switch S3.

The first switch S1 has one end connected to the positive power terminal and the other end connected to an end of the second switch S2.

The second switch S2 has one end connected to the other end of the first switch S1 and the other end connected to one end of the third switch S3.

The third switch S3 has one end connected to the other end of the second switch S2 and the other end connected to the negative power terminal.

The first heating coil Lr1 (230) has one end connected to a contact point between the other end of the first switch S1 and one end of the second switch S2 and the other end connected to the plurality of capacitors included in the first resonant capacitor Cr11 and Cr12 (250).

The second heating coil Lr2 (240) has one end connected to a contact point between the other end of the second switch S2 and one end of the third switch S3 and the other end connected to the plurality of capacitors included in the second resonant capacitor Cr21 and Cr22 (260).

The first heating coil Lr1 (230) and the first resonant capacitor Cr11 (250) constitute a first resonant circuit to serve as a first burner. The second heating coil Lr2 (240) and the second resonant capacitor Cr12 (260) constitute a second resonant circuit to serve as a second burner.

An anti-parallel diode is connected to each of the switches S1, S2, and S3 included in the inverter 220. Also, an auxiliary resonant capacitor parallely connected to the anti-parallel diode for minimizing a switching loss of each of the switches is connected to the each of the switches S1, S2, and S3.

The switching signal generation part 270 is connected to a gate terminal of each of the first, second, and third switches S1, S2, and S3 of the inverter 220. Thus, the switching signal generation part 270 outputs a gate signal for controlling a switching state of each of the first, second, and third switches S1, S2, and S3. The gate signal may be a switching signal for determining the switching state of each of the first, second, and third switches S1, S2, and S3.

The switching signal generation part 270 will be described below with reference to FIG. 3.

The switching signal selection part 280 receives a switching selection signal from the outside to select an operation mode of the induction heat cooking apparatus 200 according to the received switching selection signal, thereby outputting a control signal for determining a state of a switching signal to be generated in the switching signal generation part 270 according to the selected operation mode.

The switching signal selection part 280 may receive the signal for respectively or simultaneously operating the first and second heating coils Lr1 and Lr2 (230 and 240). The switching signal selection part 280 may output a control command with respect to a switching operation signal to be generated in the switching signal generation part 270 on the basis of the inputted signal.

Figure 3:
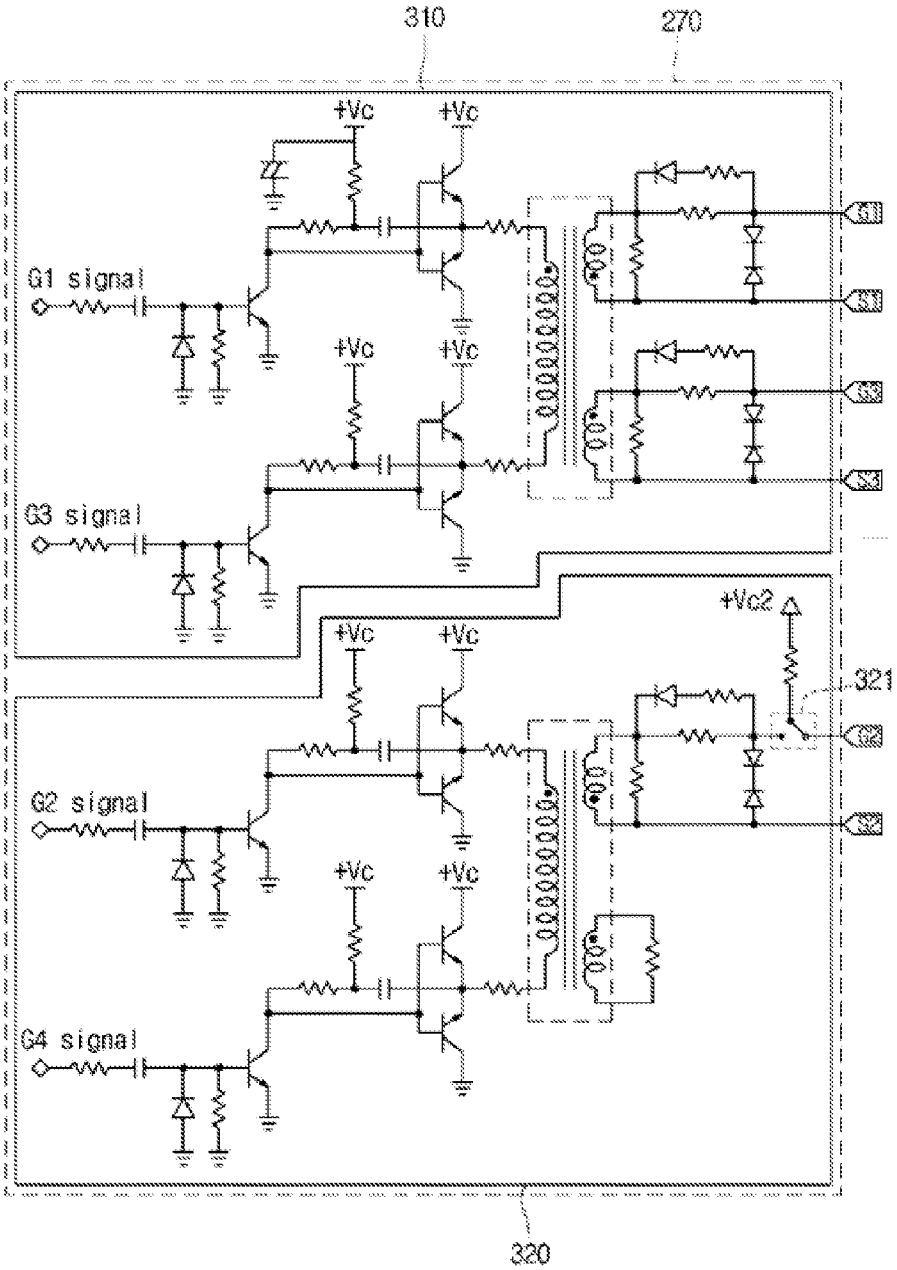
FIG. 3 is a circuit diagram of a switching signal generator according to one embodiment.
Figure 4:
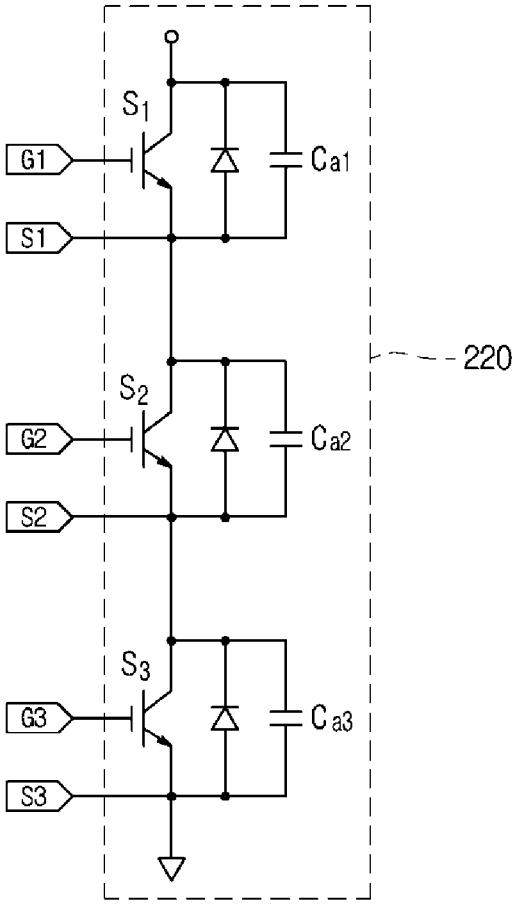
FIG. 4 is a circuit diagram illustrating input of a signal generated in the switching signal generator to an inverter according to an embodiment.

FIG. 3 is a circuit diagram of a switching signal generation part according to an embodiment, and FIG. 4 is a circuit diagram illustrating an input of a signal generated in the switching signal generator to the inverter according to an embodiment.

Referring to FIG. 3, the switching signal generation part 270 may apply a switching control signal to each of the plurality of switches S1, S2, and S3.

As shown in FIG. 4, the switching signal generation part 270 may include a pulse transformer for independently controlling the three switches S1, S2, and S3 included in the inverter 220 constituted by a dual half bridge circuit. In the current embodiment, two pulse transformers may be provided to control the dual half bridge constituted by the three switches.

As shown in FIG. 3, the switching signal generation part 270 may include a first pulse transformer 310 for controlling the first and third switches S1 and S3 and a second pulse transformer 320 for controlling the second switch S2.

The second pulse transformer 320 may further include an independent control voltage Vc2 and relay 321 to continuously maintain an opening or closing state of the second switch S2 according to an operation request signal of each for the first and second heating coils Lr1 and Lr2 (230 and 240).

The first and second pulse transformers 310 and 320 may control an opening/closing of each of the switches S1, S2, and S3 by using an output waveform oscillated from a timer (not shown) generating pulses. Also, when an operation request signal for independently operating the first heating coil Lr1 (230) is inputted, the switching signal generation part 270 may output an oscillated output waveform for controlling the first to third switches to selectively operate only a first resonant circuit.

Also, when an operation request signal for independently operating the second heating coil Lr2 (240) is inputted, the switching signal generation part 270 may output an oscillated output waveform for controlling the first to third switches according to a second switching signal to selectively operate only a second resonant circuit.

Also, when a simultaneous operation signal of the first and second heating coils Lr1 and Lr2 (230 and 240) is inputted, the switching signal generation part 270 may output an oscillated output waveform for closing the first and third switches S1 and S3 and opening the second switch S2 to operate the first and second resonant circuits.

That is, since the first transformer 310 connects the first switch to the third switch, when an operation signal of the first heating coil 230 is inputted, the first switch may be closed, and the second switch of the second pulse transformer 320 may be continuously opened or closed. Also, when an operation signal of the first heating coil Lr1 (230) is inputted, the first switch may be turned off, and the third switch is closed to continuously open or close the first to third switches, thereby operating the second resonant circuit together with the second switch.

As described above, the switching signal generation part 270 including the pulse transformers 310 and 320 to correspond to the switches, thereby operating the dual half bridge inverter including the three switches was described according to an embodiment. An operation of the induction heat cooking apparatus according to an embodiment will be described by using the above-described components with reference to FIG. 5.

Figure 5:
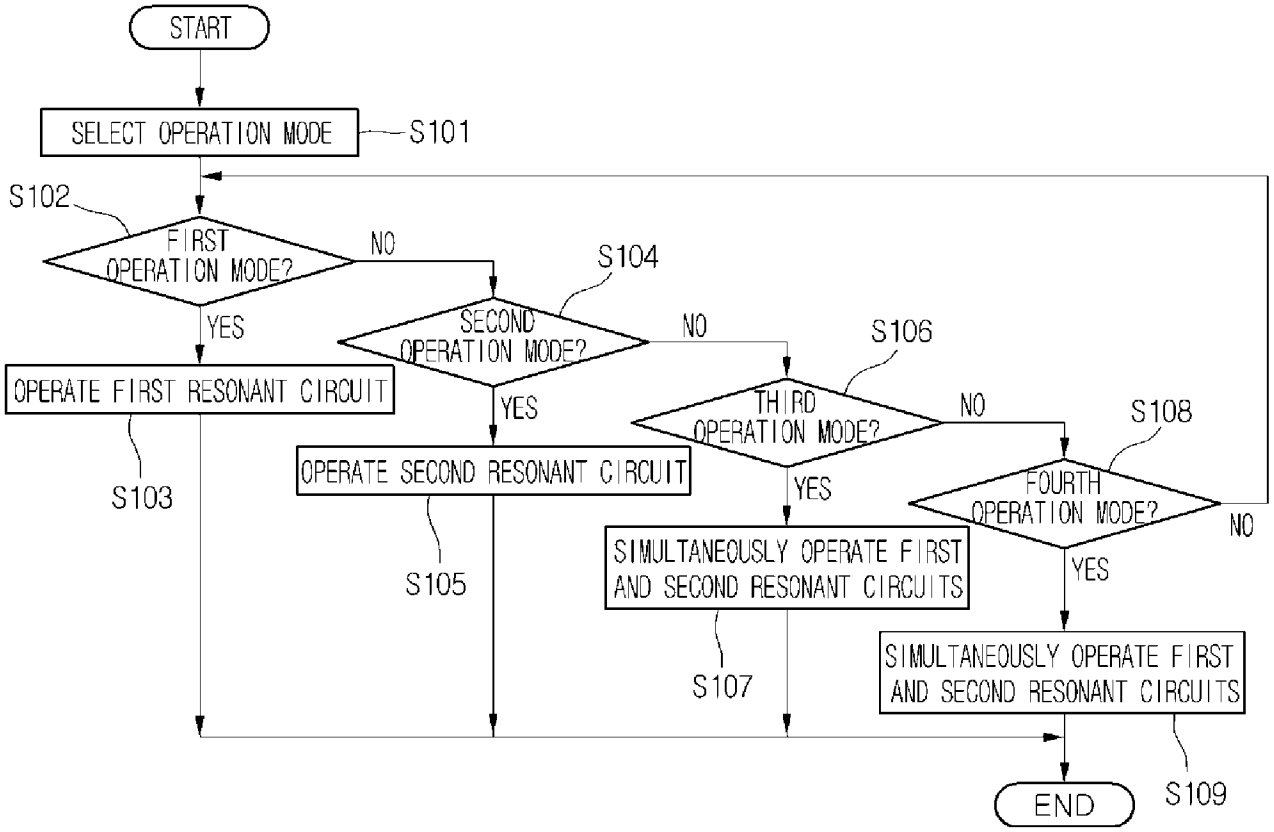
FIG. 5 is a flowchart illustrating an operation of the induction heat cooking apparatus according to an embodiment.

FIG. 5 is a flowchart illustrating an operation of the induction heat cooking apparatus according to an embodiment.

Referring to FIG. 5, a switching signal selection part 280 may receive an operation mode selection signal from the outside (S101).

The switching signal selection part 280 may determine whether an operation mode selection signal inputted from the outside is a first operation mode for operating the first heating coil Lr1 (230) (S102).

If the first operation mode for operating the first heating coil Lr1 (230) is selected, the switching signal selection part 280 may output a corresponding signal to a switching signal generation part 270. The switching signal generation part 270 controls the state of each of the first to third switches S1 to S3 included in the inverter 220. That is, the switching signal generation part 270 closes the first and second switches and opens the third switch to operate only a first heating coil Lr1 (230) and a first resonant circuit 250 (S103).

As the determination result (S102), if an independent operation request signal of the first heating coil Lr1 (230) is not inputted, the switching signal selection part 280 may determine whether a second operation mode request signal for independently operating a second heating coil Lr2 (240) is inputted (S104).

If the signal for independently operating only the second heating coil Lr2 (240) is inputted, the switching signal selection part 280 may output a corresponding signal to the switching signal generation part 270.

The switching signal generation part 270 controls the state of each of the first to third switches included in the inverter 220. That is, the switching signal generation part 270 closes the second and third switches and opens the first switch to operate only the second heating coil Lr2 (240) and a second resonant circuit 260 (S105).

As the determination result (S104), if an operation signal of the second heating coil Lr2 (240) is not inputted, the switching signal selection part 280 may determine whether a third operation mode for operating the plurality of heating coils is selected (S106).

If a signal for operating the first and second heating coils Lr1 and Lr2 (230 and 240) at the same time is inputted, the switching signal selection part 280 may output a corresponding signal to the switching signal generation part 270.

If the third operation mode is selected, the switching signal selection part 280 may operate the first resonant circuit including the first heating coil Lr1 (230) and a first resonant capacitor 250 and the second resonant circuit including the second heating coil Lr2 (240) and a second resonant capacitor 260 through the switching signal generation part 270.

As the determination result (S106), if a third operation mode request signal for operating the first and second heating coils Lr1 and Lr2 (230 and 240) at the same time is not inputted, the switching signal selection part 280 may determine whether a fourth operation mode for alternately operating the first and second heating coils Lr1 and Lr2 (230 and 240) is selected (S108).

If a signal for alternately operating the first and second heating coils Lr1 and Lr2 (230 and 240) is inputted, the switching signal selection part 280 may output a corresponding signal to the switching signal generation part 270.

The switching signal generation part 270 controls the state of each of the first to third switches included in the inverter 220. That is, the switching signal generation part 270 closes the first and second switches and opens the second switch preferentially to operate the first and second heating coils 230 and 240 preferentially, and then opens the first switch and closes the third switch to operate the second heating coil 240 and the second resonant circuit 260. Here, the second switch may be continuously closed. Also, the alternate operation order of the heating coils is not limited.

Thus, the above-described operations may be continuously performed to alternately operate the first and second heating coils for a predetermined period (S109).

If a person of ordinary skill in the art to which this disclosure pertains without departing from the essential characteristics of the present disclosure in the range described above, is only the spirit of the present disclosure have been described for illustrative purposes, various modifications, additions and substitutions are possible.

According to the embodiments, since the plurality of heating coils are operated by using only the one inverter including the three switching devices, the induction heat cooking apparatus may be simplified in circuit and reduced in volume to reduce product unit costs.

Also, according to the embodiments, the circuit for operating the plurality of heating coils at the same time by using only the one inverter may be provided to improve user satisfaction.

Embodiments provide an induction heat cooking apparatus including a constitution for generating a gate voltage that operates two resonant circuits by using an inverter including three switches.

The feature of the inventive concept is not limited to the aforesaid, but other features not described herein will be clearly understood by those skilled in the art from descriptions below.

In one embodiment, an induction heat cooking apparatus includes: a rectifying part rectifying an input voltage to output a DC voltage; an inverter switching the DC voltage outputted through the rectifying part to generate an AC voltage; a first heating part operated by the AC voltage applied from the inverter; a second heating part connected to the first heating part in parallel, the second heating part being operated by the AC voltage applied from the inverter; and a switching signal generation part controlling an operation state of each of the first and second heating parts from the inverter according to an operation mode inputted from the outside, wherein the switching signal generation part includes a pulse transformer.

In another embodiment, a method of operating an induction heat cooking apparatus including first and second heating parts includes: selecting an operation mode; outputting a switching signal for selectively operating only the first heating part of the first and second heating parts connected to each other in parallel when the selected operation mode is a first operation mode; outputting a switching signal for selectively operating only the second heating part of the first and second heating parts when the selected operation mode is a second operation mode; and outputting a switching signal for operating the first and second heating parts at the same time when the selected operation mode is a third operation mode, wherein the outputted switching signals are supplied from an inverter including first to third switches connected to each other in series and a switching signal generation part controlling the switches of the inverter.

The details of one or more embodiments are set forth in the accompanying drawings and the description below.

Other features will be apparent from the description and drawings, and from the claims.

Therefore, to explain the embodiments disclosed in the present disclosure is not limited to the technical idea of the present disclosure, and are not limited by this embodiment without departing from the scope or spirit of the disclosure.

The scope of protection of the present disclosure, all the technical idea, within the scope of its equivalent shall be construed by the following claims should be construed as being included in the scope of the present disclosure.

Any reference in this specification to "one embodiment," "an embodiment," "example embodiment," etc., means that a particular feature, structure, or characteristic described in connection with the embodiment is included in at least one embodiment of the invention. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. An induction heat cooking apparatus comprising:

a rectifier that rectifies an input voltage to output a DC voltage;

an inverter that switches the DC voltage outputted through the rectifier to generate an AC voltage;

a first heating element operated by the AC voltage applied from the inverter;

a second heating element connected in parallel to the first heating element, the second heating element being operated by the AC voltage applied from the inverter; and a switching signal generator that generates control signals for the inverter to control an operational state of each of the first and second heating elements according to a received operational mode signal, wherein the inverter includes a first switch, a second switch, and a third switch which are connected in series between a positive power terminal and a negative power terminal of the rectifier, wherein the switching signal generator includes a first pulse transformer and a second pulse transformer that controls the first to third switches of the inverter, wherein the first pulse transformer generates a control signal for operating the first and third switches, and the second pulse transformer generates a control signal for operating the second switch.

2. The induction heat cooking apparatus according to claim 1, wherein each of the first to third switches includes an anti-parallel diode and a resonant capacitor connected in parallel to the anti-parallel diode.

3. The induction heat cooking apparatus according to claim 1, wherein the second pulse transformer includes a control power source and a relay to control the second switch to be continuously opened or closed when the first and second heating elements are operated.

4. The induction heat cooking apparatus according to claim 1, wherein the switching signal generator generates control signals according to prescribed operational modes selected based on input signals.

5. The induction heat cooking apparatus according to claim 4, wherein the switching signal generator generates control signals to close the first and second switches in response to an input signal for a first mode.

6. The induction heat cooking apparatus according to claim 5, wherein the switching signal generator generates control signals to open the first switch and close the second and third switches in response to an input signal for a second mode.

7. The induction heat cooking apparatus according to claim 6, wherein the switching signal generator generates control signals to open the first switch and close the second and third switches in response to an input signal for a third mode.

8. An induction heat cooking apparatus comprising:

a rectifier that rectifies an input voltage to output a DC voltage;

an inverter that switches the DC voltage outputted through the rectifier to generate an AC voltage;

a first heating element operated by the AC voltage applied from the inverter;

a second heating element connected in parallel to the first heating element, the second heating element being operated by the AC voltage applied from the inverter; and a switching signal generator that generates control signals for the inverter to control an operational state of each of the first and second heating elements according to a received operational mode signal, wherein the inverter includes a first switch, a second switch, and a third switch connected in series, the first heating element being connected between the first and second switches and the second heating element being connected between the second and third heating elements, wherein the switching signal generator includes a first pulse transformer that generates control signals for the first and third switches and a second pulse transformer that generates control signals for the second switch.

9. The induction heat cooking apparatus according to claim 8, wherein the control signal for the first switch and the control signal for the second switch are dependent on each other.

10. The induction heat cooking apparatus according to claim 8, wherein the second pulse transformer includes a control power source and a relay to control the second switch to be continuously opened or closed when the first and second heating elements are operated.

11. The induction heat cooking apparatus according to claim 8, wherein the switching signal generator generates control signals to selectively operate the first heating element, the second heating elements, or both first and second heating elements.

* * * * *